United States Patent [19]

Hanada et al.

[11] 3,941,591

[45] Mar. 2, 1976

[54] ELECTROPHOTOGRAPHIC PHOTOCONDUCTIVE MEMBER EMPLOYING A CHALCOGEN ALLOY AND A CRYSTALLIZATION INHIBITING ELEMENT

[75] Inventors: Hiroshi Hanada, Yokohama; Nobuo Kitajima, Akishima; Tatsuo Masaki, Tokyo, all of Japan

[73] Assignee: Canon Kabushiki Kaisha, Tokyo, Japan

[22] Filed: Oct. 30, 1974

[21] Appl. No.: 519,277

Related U.S. Application Data

[63] Continuation of Ser. No. 280,223, Aug. 14, 1972, abandoned, which is a continuation of Ser. No. 3,050, Jan. 15, 1970, abandoned.

[30] Foreign Application Priority Data

Jan. 22, 1969 Japan ..... 44-4633
Aug. 23, 1969 Japan ..... 44-67004

[52] U.S. Cl. ..... 96/1.5; 252/501
[51] Int. Cl.[2] ..... G03G 5/082
[58] Field of Search ..... 96/1.5; 252/501

[56] References Cited

UNITED STATES PATENTS

| | | | |
|---|---|---|---|
| 2,662,832 | 12/1963 | Middleton et al. | 96/1.5 X |
| 2,894,159 | 7/1959 | Sheldon | 252/501 X |
| 2,953,529 | 9/1960 | Schultz | 252/501 X |
| 2,994,621 | 8/1961 | Hugle et al. | 252/501 X |
| 3,271,591 | 9/1966 | Ovshinsky | 307/258 |
| 3,457,070 | 7/1969 | Watanabe et al. | 96/1.5 X |
| 3,530,441 | 9/1970 | Ovshinsky | 96/1.5 X |
| 3,607,388 | 9/1971 | Hori et al. | 96/1.5 X |
| 3,627,573 | 12/1971 | Schottmiller et al. | 252/501 X |
| 3,647,427 | 3/1972 | Hanada et al. | 96/1.5 |
| 3,769,010 | 10/1973 | Hanada et al. | 96/1.5 |
| 3,801,966 | 4/1974 | Jerao | 96/1.5 X |

FOREIGN PATENTS OR APPLICATIONS

| | | | |
|---|---|---|---|
| 1,031,864 | 6/1966 | United Kingdom | 96/1.5 |
| 39-14450 | 7/1964 | Japan | 96/1.5 |

OTHER PUBLICATIONS

Cassiers, "Memory Effects in Electrophotography," Journal of Photographic Science, Vol. 10, 1962, pp. 57–64.

Claus, "Advances in Xerography: 1958–1962," Photographic Science & Engineering, Vol. 7, No. 1, Jan.–Feb. 1963, pp. 5,8–9, and 14.

*Primary Examiner*—David Klein
*Assistant Examiner*—John R. Miller
*Attorney, Agent, or Firm*—Fitzpatrick, Cella, Harper & Scinto

[57] ABSTRACT

An electrophotographic photosensitive member having a photosensitive layer containing an amorphous alloy comprising at least one of the chalcogen elements and at least one element from group IVa of the Periodic Table. This photosensitive layer can be sensitized by adding an element from group Va of the Periodic Table or a halogen thereto.

6 Claims, 4 Drawing Figures

*INVENTOR.*

*BY*

ELECTROPHOTOGRAPHIC PHOTOCONDUCTIVE MEMBER EMPLOYING A CHALCOGEN ALLOY AND A CRYSTALLIZATION INHIBITING ELEMENT

This is a continuation of application Ser. No. 280,223, filed Aug. 14, 1972 now abandoned which in turn is a continuation of Ser. No. 3,050 filed Jan. 15, 1970, now abandoned.

This invention relates to an electrophotographic photosensitive member, more particularly to an electrophotographic photosensitive member characterized by having a photosensitive layer containing photosensitive material possessing a high resistance in the dark, a stable amorphous state, and having excellent sensitivity, resolution and panchromatic properties.

Many substances have hitherto been taken into consideration as photoconductive material. However, a photosensitive member which utilizes the charging process is required to store the electrical charge on its surface for a little while. For this purpose, the photosensitive layer is desired to have a volume resistivity of some $10^{12}$ to $10^{15}$ Ω-cm which, upon exposure to light irradiation, should be reduced appropriately.

Known examples of amorphous photosensitive materials for use in electrophotography having such photoconductive characteristics include such chalcogen elements as selenium and selenium containing tellurium or mixtures produced by adding elements belonging to Group Va of Periodic Table of elements such as arsenic and antimony to the above-mentioned chalcogen mixture or chalcogen elements in order to improve the sensitivity of the photosensitive material. The term "chalcogen elements" is the general term for sulfur S. selenium Se, and Tellurium Te.

Among the amorphous photosensitive materials consisting of these chalcogen elements, the photosensitive materials composed mainly of selenium are the most useful.

However, amorphous photosensitive materials composed mainly of selenium have the drawback that they tend to start crystallization at higher-than-normal temperatures, and this crystallization is accelerated or produced by surrounding conditions such as temperature change and light irradiation. This crystallization is an extremely inconvenient phenomenon since it reduces the resistivity of selenium in the dark which results in degradation of the photosensitive member and, depending on the degree of crystallization, shorten the life of the photosensitive member. For example, although the volume resistivity of amorphous selenium in the dark is $10^{12}$ Ω-cm or more, that of crystallized selenium is reduced to a degree of $10^{6}$ Ω-cm. In this state, selenium can not be used as a photosensitive material.

When using such amorphous photosensitive materials is selenium, especially when producing a photosensitive plate with such materials, since crystallization results from an increase in temperature, it is necessary to keep the temperature the evaporation base at a constant value by having the evaporation base contact a heat bath kept at a constant temperature to discharge heat to the heat bath.

At the same time, evaporation temperature must also be controlled. The evaporation equipment for vapor deposition is required to be of high accurate and complex construction especially when evaporation is made on a rotating drum-shaped evaporation base. This not only complicated the manufacturing process of the photosensitive plate but also impeded manufacturing costs.

Furthermore, crystallization is a problem not to be solved mostly by prevention of crystallization during the course of manufacturing the photosensitive member, but causes considerable degradation of the photosensitive member due to environmental conditions later as mentioned above.

When a crystallized substance is used, as the photosensitive material, resistance in the dark is increased by making the powder of the crystal disperse in a highly insulating resin. In such a case, however, reduction in photosensitivity cannot be avoided combined with the problem of dispersion of the crystal powder.

On the other hand, the photosensitive member composed mainly of selenium generally show a poor response to red rays of light, and therefore is not as panchromatic, a characteristic needed for reproducing colored images. On the other hand, a photosensitive member of selenium-tellurium alloy made by adding tellurium to selenium is sensitive to light of the red region. In this case, although the red sensitivity of the photosensitive member is increased and the photosensitive member becomes panchromatic with the increase in the amount of Te added, and while at the same time photosensitivity of the photosensitive body is increased as compared with the case in which Se is used alone, an increase in the amount of Te added is accompanied by an increase in the tendency of crystallize and consequently leads to reducing the life and degrading the durability of the photosensitive member. For these reasons, the amount of tellurium actually added is generally limited to below 10% in weight, taking into consideration the durabiliy of the photosensitive member. This still leaves problems in putting this kind of photosensitive member to practical use. Besides selenium and tellurium, are known the photosensitive members made by activating cadmium sulfide (CdS) with activators such as copper, silver, and halides, binding the activated cadmium sulfide with binder resin to form the photosensitive layer, and placing an insulating layer on the surface of the photosensitive layer. These photosensitive members are used in electrophotographic precesses utilizing the rectifying effect of the photosensitive layer (for example, the electrophotographic processes disclosed in U.S. Ser. No. 563,899 filed July 8, 1966 and U.S. Ser. No. 571,538 filed Aug. 10, 1966, now abandoned, and are in practical use because they can obtain a sensitivity approximately 10 times as high as that of the aforementioned selenium photosensitive plate. However, these photosensitive members have a drawback in that they are poor in resolution and in panchromatic sensitivity because CdS is almost insensitive to the short wavelength region of visible light, that is, have light having a wavelength between 400 and 500 mμ. As has been described so far, the typical conventional photosensitive members have their own merits and demerits, respectively, and the development of a photosensitive member having all of the characteristics such as high sensitivity, high resolution, panchromatic property, and durability is urgently demanded in connection with the development of color electrophotography.

An object of this invention is to provide an electrophotographic photosensitive member having a photosensitive layer comprizing a novel component or components that meet the abovementioned demand.

A further object of this invention is to provide an amorphous photosensitive member capable of being produced by a simplified method. Another object of this invention is to provide an electrophotographic photosensitive member suitable for color electrophotography.

A still further object of this invention is to provide an electrophotographic photosensitive member that has a sensitivity, panchromatic property and durability sufficient to be applied to various electrophotographic processes.

The electrophotographic photosensitive member of this invention which attains each of the above-mentioned objects will become evident from the following description, in conjunction with the accompanying drawings, in which.

Figure 1:
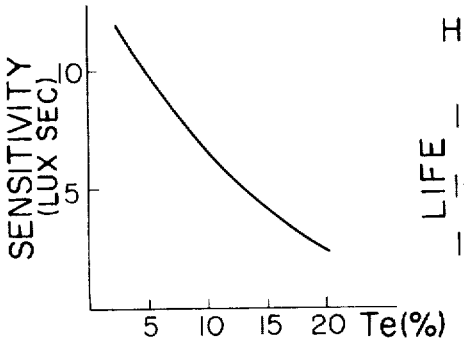
FIG. 1 is a correlation chart between the Te content of a conventional photosensitive member having a Se-Te alloy evaporated photosensitive layer and the sensitivity thereof.

The photosensitive member of this invention is characterized by having a photosensitive layer comprising stable amorphous photosensitive material containing as a main component at least one of the chalcogen elements and at least one of the elements selected from those belonging to group 1Va of the Periodic Table, such as carbon (C), silicon (Si), germanium (Ge), tin (Sn) and lead (Pb).

The constituents of the photosensitive layer according to this invention are mainly chalcogen elements to which a relatively small amount of group 1Va elements in added. The amount of 1Va elements to be added to the chalcogen element is such that the photosensitive material will have an electric resistance of $10^{12}$ Ω-cm or more in the dark and have a sensitivity and panchromatic characteristic to meet the requirements of electrophotography to which this invention is applied. Generally, good results are obtained when 30 wt% or less, especially 10 wt% or less, based on the chalcogen elements, of 1V*a* elements is added to the chalcogen elements. However, this amount may be increased without any trouble depending on the sensitivity characteristics required for the photosensitive member. Addition of elements belonging to group Va of the Periodic Table such as phosphorus (P), arsenic (As), antimony (Sb), bismuth (Bi) and the like, or halogens, which are the sensitizing elements that increase the sensitivity of chalcogen elements, with a purpose of improving the sensitivity, also offers desirable results. The combination of constituents of photosensitive material according to this invention that is, the combination of chalcogen elements with group 1Va elements, can be determined based on two technical considerations. One of them is that the 1Va group elements have been newly found to act effectively to prevent the crystallization of amorphous chalcogen elements. This has made it possible to offer a photosensitive material excellent in durability and capable of producing a photosensitive member which is free from degradation due to crystallization even after a long period of use, by adding the group 1V*a* elements to at least one of the chalcogen elements. The other is that not only the group 1V elements have been found to have the crystallization-preventing effect on amorphous chalcogen elements, but is has also been newly found that they, when added, act rather to improve the photosensitivity of amorphous chalcogen elements without impairing the intrinsic characteristics of the amorphous chalcogen elements such an sensitivity, resolution, electrical resistance in the dark and the like. In this case, by adding the group 1Va elements to selenium-tellurium system chalcogen, which has hitherto been unable to be practically used because of its intense tendency of crystallization although it has an excellent panchromatic characteristic, an unexpectedly high sensitive, panchromatic, and durable photosensitive element can be obtained. Now a case in which the IV*a* elements are added to the selenium-tellurium system to offer a particularly excellent photosensitive material will be described. First, the correlations between Te contents of the photosensitive member having an Se-Te alloy evaporated photosensitive layer and sensitivity and durability will be described in detail.

FIG. 1 shows a graph indicating that the sensitivity ordinate of the photosensitive member is increased with an increase in Te content of a Se-Te alloy evaporated photosensitive layer. In this case, the sensitivity is represented by the amount of optical image exposure expressed in lux. sec required to obtain an electrostatic contrast of 300V. between the light portion and dark portion on the surface of the photosensitive member. The graph means that the smaller the value of exposure amount, the higher the sensitivity is. The procedure of experiment by the present inventors in preparing this graph will be roughly described in the following.

Figure 2:
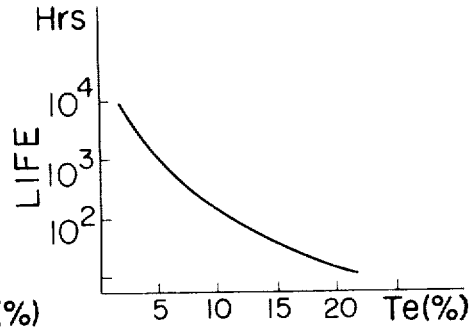
FIG. 2 is a correlation chart between the Te content of the same photosensitive member and the life thereof.

Many kinds of Se-Te alloys different in Te content were prepared first. Each Se-Te alloy was evaporated on to an aluminum plate to a thickness of approximately 60 μ. On the surface of the Se-Te alloy layer was bound a Mylar (Trade name) film of approximately 25 μ in thickness by using epoxy resin to form an insulating layer. Next, the electrophotographic process disclosed in U.S. Ser. No. 571,538 filed Aug. 10, 1966 was applied to each photosensitive member. That is, primary charging was performed by corona discharge until the surface potential of the photosensitive member became minus 2000V. Next, light image exposure was made while AC corona discharge was being carried out by a voltage of approximately 6KV. Finally, the whole surface of the photosensitive member was subject to a uniform exposure to form an electrostatic latent image. The exposure amount required to produce an electrostatic contrast of 300V. between light and dark portions of the electrostatic latent image thus obtained was expressed in lux. sec. Next, FIG. 2 is a graph indicating that the increase in Te content results in a decrease in the life of the photosensitive member and consequently in degradation of its durability. The life in this case is represented by the time required for the photosensitive member to be degraded due to aging to a degree where the latent-image forming ability is remarkably reduced and becomes of no use. Actually, each photosensitive member described din FIG. 1 was subjected to forcible degradation by keeping it under various temperatures above room temperature, and the time required for losing the latent-image forming ability suddenly was measured. Then, the life of each photosensitive member at room temperature was estimated from the time measured as above and the temperature under which the experiment was made. The reason why the life of the photosensitive member was shortened and its durability was degraded is that crystallization of Se-Te is accelerated in a Se-Te alloy containing a high percentage of Te, and this crystallization in turn causes an extreme decrease in the resistance of the alloy and diminishes the surface charge holding ability of the photosensitive member. Therefore, if, by some means or other, it is possible to suppress the crystallization of Se-Te as mentioned above, the above-mentioned problem of durability of this kind of photosensitive member will be solved, and it is clear that an excellent photosensitive member will be obtained. Through many experiments, the present inventors have discovered that crystallization hardly occurs or does not occur even in an Se-Te alloy which has a large Te content if only a small amount of group IV*a* elements is added to the Se-Te alloy. The present inventors have found further that, when the photosensitive material composed of chalcogen elements is an Se-Te alloy, the crystallization-preventing effect differs somewhat depending on the group IV*a* elements added, that addition of Ge or Si or both is most effective. By forming a glassy alloy evaporated photosensitive layer composed mainly of Se and Te in a form of Se-Te-Ge alloy, Se-Te-Si alloy, or Se-Te-Ge-Si alloy. the above-mentioned problem of durability degradation of photosensitive member due to crystallization of Se-Te is solved and, by the elimination of Te content limitation, a photosensitive member which is more sensitive, more panchromatic, and more powerful in resolution than before can be obtained.

Figure 3:
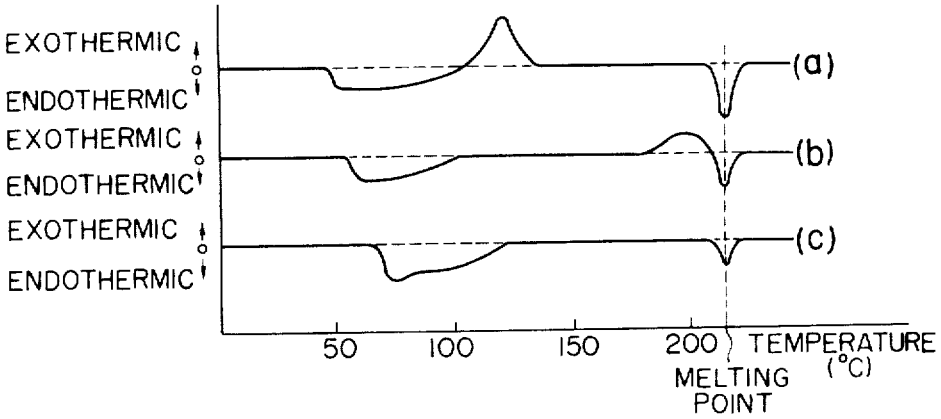
FIG. 3 shows differential thermal analysis curves for Se-Te alloys and Se-Te-Ge alloys according to this invention.

In order to prove the fact that addition of Ge or Si or both to a Se-Te alloy either suppresses or stops crystallization, results obtained from differential thermal analysis Se 90%, Te 10% alloy, Se 86.5%, Te 13% . Ge 0.5% alloy, Se 86% . Te 13% . Ge 1% alloy are shown in FIG. 3 with curves *a*, *b*, and *c*, respectively. Differential thermal analysis is a means to obtain information about the phase change of a substance by investigating the exothermic or endothermic state produced accompanying the a phase change of the substance when heated or cooled. In FIG. 3 the peak above the reference line of each curve obtained by thermal analysis shows the exothermic state caused by crystallization and the peak below the reference line shows the endothermic state that corresponds to softening and melting. These results show that the Ge-free Se-Te alloy has a large crystallization peak in the curve a, but the Se-Te-Ge alloy that contains 0.5% of Ge has a small crystallization peak as shown in the curve b showing that crystallization hardly occurs. In the case of Se-Te-Ge alloy containing 1% of Ge, no crystallization peak is present as shown by the curve c,. However, crystallization depends on the rate of increase of temperature and occurs at lower temperatures when the rate of increase is slowed down. The results of analyses shown in FIG. 3 were obtained from measurements conducted at a heating rate of approximately 10°C/min. It should be noted that the amount of Ge required for preventing the formation of a crystallization peak is further increased when the heating rate is slowed down. In either case, by the addition of a small amount of Ge, the Se-Te alloy becomes glassy and hardly crystallizes. It was also ascertained that the same result was obtained by the addition of Si or Ge and Si.

Figure 4:
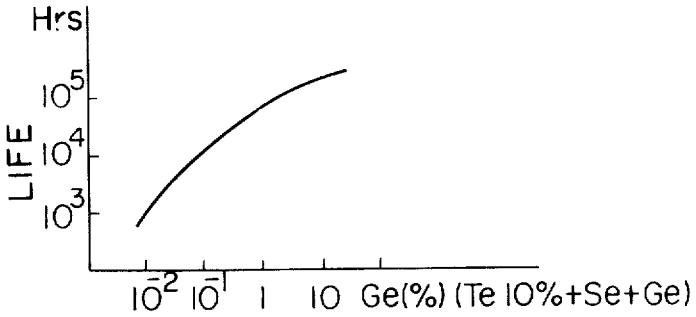
FIG. 4 is a correlation chart between the Ge content of the photosensitive member having a Se-Te (10%)-Ge alloy evaporated layer which is an embodiment of this invention and the life thereof.

Furthermore, when the amount of Ge or Si or both to be added approaches 10% by weight, the sensitivity of the photosensitive member gradually decreases and requires an increase in the temperature of the evaporation source when evaporating or use of a combination evaporating method. These things inevitably result in difficulties when producing photosensitive members. Therefore, the desirable amount of additive is 10wt.% or less when the chalcogen element is Se-Te alloy. FIG. 4 shows the relationship between the Ge content of the photosensitive element according to this invention having an Se-Te (10%)-Ge alloy evaporated photosensitive layer and the life thereof. It is clearly seen that the life or the durability of the photosensitive member is improved with the increase in Ge content. This graph was prepared on the same principle as the graph of FIG. 2. Next, the general configuration of the photosensitive member according to this invention will be described hereinafter.

The photosensitive member may have the following constitutions, for example, a photosensitive layer on a support; three layer constitution comprising an insulating layer, a photosensitive layer and a conductive or insulating support; and a four layer constitution comprising an insulating layer, a photosensitive layer, an insulating layer and a conductive layer, and in he above constitutions, particularly, the latter two, at least one layer adjacent to the photosensitive layer is transparent to a radiation to which the photosensitive layer is sensitive.

The photosensitive member having a photosensitive layer composed of amorphous photosensitive material according to this invention can naturally be used as the photosensitive member of general electrophotography comprising the steps of charging, original image irradiation, development (transcription), and fixation. Moreover the said photosensitive member can be used as the photosensitive member of electrophotographic processes disclosed in U.S. Ser. No. 563,899 filed July 8, 1966 and U.S. Ser. No. 571,538 filed Aug. 10, 1966 in which such procedures as primary charging, secondary charging or AC discharge plus simultaneous exposure, and whole surface irradiation are included.

The amorphous photosensitive material according to this invention is not excited to crystallize at temperatures higher than normal temperature and the crystallizing tendency is not observed regardless of environmental conditions such as light irradiation.

As for the manufacture of the photosensitive member, the use of conventional complicated evaporating equipment provided with a cooling device for prevention of crystallization is not required and further the fear of later degradation of the photosensitive member can be completely removed. For example, as will be shown in the example described later, during the course of manufacturing the photosensitive member, crystallization is not excited even when the cooling of evaporation base at evaporation is omitted, tendency there is no to crystallize even after a continuous irradiation of light, nor is there a reduction in resistance in the dark. Although the reason why the photosensitive material according to this invention has a high dark resistance and a property to form a stable amorphous substance is not clear at present, it is believed that the elements belonging to the IV*a* group are relatively heterogenous as compared with the chalcogen elements and the incorporation thereof with the chalcogen elements may prevent the crystallization the chalcogen elements, and at the same time, affect favorably the dark resistance and photoconductive characteristic of the photosensitive layer. The main effects of this invention that have so far been described will be summarized as follows:

1. A photosensitive member provided with high sensitivity, high resolution, panchromatic characteristic, and durability can be obtained. This will greatly contribute to the development of electrophotography especially that of color electrophotographic techniques.

2. The amorphous photosensitive material according to this invention relaxes restrictions on manufacturing methods by making the cooling and temperature control process unnecessary, enabling the photosensitive member to be made easily with very simple equipment, reducing the manufacturing cost, extending the life of the photosensitive member, and keeping the photosensitivity constant during its life. In short, the said amorphous photosensitive material has an excellent effect when used in electrophotography, particularly in the above-mentioned process.

3. Since the Se-Te alloy has excellent properties as a photosensitive material and hardly crystallizes, it is possible to apply a heat treatment after evaporating deposition which was not possible heretofore, and further the properties can be delicately controlled by forming microcrystals in the photosensitive layer according to the above treatment.

4. Moreover, the Se-Te alloy shows P-type electric conductivity. This P-type tendency is further increased by the addition of Ge and Si and as the photosensitive member for electrophotographic process disclosed, for example, in U.S. Ser. No. 563,899 filed July 8, 1966 and U.S. Ser. No. 571,538 filed August 10, 1966 has a more remarkable rectifying property and consequently can show a high contrast.

This invention will be described in more detail by referring to the following examples. The following examples should be constructed as illustrations of the invention and not limitations thereof.

EXAMPLE 1

The powders having a Se, Te, and Ge of purity of more than 99.9% were combined in a weight ratio of 89.9 : 10 : 0.1. The mixture was enclosed in a quartz ampoule vacuumized to approximately $10^{-3}$ Torr. Next, this ampoule was subjected to heating for 5 hours at approximately 55°C to melt the contents. It is advisable to agitate the melted body completely by either shaking or rotating the ampoule here. Next, the ampoule was thrown into water for rapid cooling and thus a glassy alloy of Se-Te-Ge was obtained. The alloy obtained above was vacuum evaporated onto an aluminum base plate to form a photosensitive layer approximately 60 $\mu$ thickness. The conditions for vacuum evaporation were such that the degree of vacuum was $10^{-4}$ - $10^{-5}$ mm Hg. the temperature of the base plate was within the range from 60° to 78°C, though the temperature was changed more or less during evaporation, and the temperature of the evaporation source was approximately 250°C.

After ending the evaporation, the base plate was cooled rapidly to room temperature, then annealed in a thermostatic oven for approximately 5 hours at 45°C. This resulted in the separation of fine crystals of alloy within the photosensitive layer and in a remarkable increase in the sensitivity of the photosensitive member.

Next, a Mylar (trade name) film 25 $\mu$ in thickness was bonded to the surface of the photosensitive layer using a small amount of epoxy resin, and thus a three-layer photosensitive member was produced.

By applying the electrophotographic process disclosed in U.S. Ser. No. 571,538 filed Aug. 10, 1966 to this photosensitive member a high sensitivity sufficient to give an electrostatic contrast of 300V at the exposure of 5 lux. sec. was obtained. The photosensitive member was excellent in resolution, panchromatic characteristic, and durability.

EXAMPLE 2

As alloy, materials powders of Se, Te, Ge, and Si were combined in a weight ratio of 80 : 19 : 0.5 : 0.5. A glassy alloy was prepared by treating the mixture in a similar way to Example 1 and, using this alloy, a three-layer construction photosensitive element was obtained in a similar way to Example 1. Annealing after evaporation was carried out for 40 hours at 50°C. As the result of applying the electrophotographic process similar to Example 1 to this photosensitive member, an excellent sensitivity sufficient to give an electrostatic contrast of 300V at an exposure of approximately 1 lux. sec was achieved.

Both resolution and panchromatic characteristics were high. And the photosensitive member showed little degradation at room temperature and was stable and durable.

EXAMPLE 3

Powders of selenium, tellurium, germanium, and sulfur in molar ratio of 60 : 20 : 10 : 10 were mixed completely, placed in a quartz ampoule. The ampoule was evacuated to about $10^{-3}$ mm Hg, sealed, and heated at 700° C for about 5 hours. The amorphous block thus obtained was placed in a tantalum boat and, using it as the evaporation source, the alloy was evaporated on the surface of an aluminum base plate of a thickness of approximately 40 $\mu$ in a vacuum approximately $10^{-5}$ mm Hg to obtain a photosensitive plate for electrophotography. The evaporation was carried out successfully without cooling of the aluminum base plate and controlling temperature during the course of evaporation. The photosensitive member thus obtained has a volume resistivity in the dark of $10^{13} - 10^{16}$ Ω-cm, which is higher by one place than $10^{12} - 10^{15}$ Ω-cm of conventional photosensitive members, and as to the sensitivity, the sensitivity of the said photosensitive member was equal to or higher than those of conventional photosensitive members.

Crystallizing characteristics of the said photosensitive member was compared with a conventional evaporated Se-Te photosensitive member containing 5% by weight of tellurium. At temperatures ranging from 28 to 32°C and under continuous light irradiation of 30 lux the difference between the dark volume resistivity immediately after light irradiation and the dark volume resistivity after about 1 year were compared for each photosensitive member. With the said conventional Se-Te photosensitive member the dark resistivities were $5 \times 10^{12}$ Ω-cm and $2 \times 10^{11}$ Ω-cm, respectively, showing a great loss in dark volume resistivity during the course of 1 year. However, with the photosensitive member according to this invention the dark volume resistivities immediately after light irradiation and after 1 year were both $3 \times 10^{13}$ Ω-cm, showing no reduction in dark resistance.

EXAMPLE 4

A mixture of powders of selenium, arsenic, germanium, and silicon in a molar ratio of 50 : 30 : 10 : 10 was used to produce a photosensitive member in the same way as Example 3. The photosensitive member obtained had a similar performance to that of Example 3.

EXAMPLE 5

Using the mixture of sulfur, selenium tellurium, bismuth, tin, and boron in a molar ratio of 20 : 20 : 20 : 10 : 10, a photosensitive member was produced in a similar way to Example 3. The photosensitive member thus produced had the same performance as that of Example 3. The photosensitive elements obtained in Examples 4 and 5 both showed photosensitivity and resolution equal to or higher than those of the conventional photosensitive member, like the case in Example 3. Fear of crystallization was removed and the photosensitive members were produced with ease.

EXAMPLE 6

Using a mixture of selenium, tellurium, germanium, and silicon in a molar ratio of 60 : 20 : 10 : 10, a photosensitive member was prepared in a similar way to Example 3. The photosensitive member obtained showed the same performance as the one obtained by Example 3.

EXAMPLE 7

A mixture of selenium 85 parts by weight, tellurium 15 parts by weight, silicon 0.3 part by weight and iodine 0.03 part by weight was used and the procedure of Example 3 was repeated to form a photosensitive member. As a result, a photosensitive member having characteristics similar to those of the photosensitive member obtained by Example 3 was produced.

EXAMPLE 8

To the surface each of the photosensitive layers of the photosensitive members of Examples 3 – 7, was applied a corona discharge of approximately 7KV to charge each surface uniformly with positive (+) charge, then the original image was irradiated by a tungsten lamp to each surface of each photosensitive layer at an intensity of approximately 10 lux for about 2 seconds to build an electrostatic latent images. Next, be developing the said electrostatic image according to the magnet brush method, a visible image of good quality with high fidelity was obtained in all cases.

EXAMPLE 9

To the surface of each of the photosensitive layers of the photosensitive members according to the abovementioned Examples 3 to 7, a Mylar film of 12$\mu$ in thickness was bonded as a light permeable insulating layer using a small amount of epoxy resin to prepare a photosensitive member comprizing three layers. Next, using these photosensitive members, a −6KV corona discharge was applied to each of the above-mentioned light permeable insulating film surfaces to charge (primary charging) the surfaces negatively and uniformly. Next, an original image was irradiated by a tungsten lamp to the abovementioned light permeable insulating film surfaces at an intensity of approximately 10 lux for about 0.1 – 0.3 seconds. Simultaneously +6KV positive corona discharge (recharging) was applied. Then the surface of each of the light permeable insulating films was exposed uniformly to the light from a 10W tungsten lamp for 1 to 2 seconds to form an electrostatic image that followed the light and dark pattern of the original image. Here, the electrostatic contrast was as high as approximately 1500V. Next, by developing these electrostatic images by the magnetic brush method, fog-free, high-density images of good quality were obtained. Moreover, if, in this example, instead of applying a +6KV positive corona discharge (recharging) simultaneously with the irradiation of original image, a 6KV AC corona discharge (recharging) was effected simultaneously with the irradiation of an original images, good quality visible image having an electrostatic contrast of approximately 100V and excellent intermediate tone were obtained. The photosensitive member of this example is an embodiment of a series of photosensitive members composed of at least a light permeating insulating layer and photosensitive layer, and this invention includes a series of photosensitive members mentioned above. As the evaporation base plate, other kinds of conductive or insulating base plates may also be used in place of the aluminum base plate. And other kinds of organic or inorganic insulating materials may be used in place of Mylar. Moreover, other binding agents may be used in place of epoxy resin.

It is desirable to employ a double corona discharge system when charging a photosensitive member with a photosensitive layer sandwiched between two insulating layers.

In this example, when the photosensitive material of the photosensitive member according to this invention is a P-type semiconductor, primary charging is made negative (−) and recharging is made positive (+). If the semiconductor is of N-type, the primary charge is positive (+) and the recharging is made to negative (−). When recharging is effected by AC corona discharge, the primary charge is negative (−) for P-type semiconductor and positive (+) for N-type semiconductor.

What is claimed is:

1. An electrophotographic photoconductive member characterized by having as a photoconductive layer an amorphous alloy consisting essentially of chalcogen elements selected from the group consisting of Se-Te and Se-Te-S, and at least one crystallization inhibiting element selected from the group consisting of silicon and germanium in an amount of 10 wt % or less based on the chalcogen elements, wherein said photoconductive layer has a volume resistivity of more than $10^{12}$ Ω-cm. in the dark.

2. An electrophotographic photoconductive member as set forth in claim 1, further including at least one member selected from the group consisting of phosphorous, arsenic, antimony, bismuth and iodine as a sensitizing additive.

3. An electrophotographic photoconductive member, comprising an electrically conductive support layer, a photoconductive layer thereon and an electrically insulating layer on said photoconductive layer forming a basic construction, wherein at least one of the layers sandwiching the photoconductive layer is transparent to radiations to which the photoconductive layer is sensitive, said photoconductive layer being composed of an amorphous alloy consisting essentially of chalcogen elements selected from the group consisting of Se-Te and Se-Te-S, and at least one crystallization inhibiting element selected from the group consisting of silicon and germanium in an amount of 10 wt. % or less based on the chalcogen elements, wherein said photoconductive layer has a volume resistivity of more than $10^{12}$ Ω-cm. in the dark.

4. An electrophotographic photoconductive member as set forth in claim 3, wherein the electrically conductive support layer includes an electrically conductive layer and an electrically insulating layer, said insulating layer being positioned between said conductive layer and said photoconductive layer.

5. An electrophotographic photoconductive member as set forth in claim 3, wherein said photoconductive layer further includes at least one member selected from the group consisting of phosphorous, arsenic, antimony, bismuth and iodine as a sensitizing additive.

6. An electrophotographic photoconductive member as set forth in claim 4, wherein said photoconductive layer further includes at least one member selected from the group consisting of phosphorous, arsenic, antimony, bismuth and iodine as a sensitizing additive.

* * * * *

UNITED STATES PATENT OFFICE

CERTIFICATE OF CORRECTION

Patent No. 3,941,591 Dated March 2, 1976

Inventor(s) HIROSHI HANADA, ET AL.

It is certified that error appears in the above-identified patent and that said Letters Patent are hereby corrected as shown below:

Column 1, line 66, "high" should read --highly--;

Column 2, line 16, "member" should read --members--;

Column 2, line 30, "of" should read --to--;

Column 2, line 35, "durabiliy" should read --durability--;

Column 2, line 56, "have light" should read --light--;

Column 3, line 41, "in added" should read --is added--;

Column 5, line 56, ",." should read --.--;

Column 6, line 26, "in he" should read --in the--;

Column 6, lines 58-59, "tendency there is no" should read --there is no tendency--;

Column 7, line 24, "evaporating" should read --evaporative--;

Column 9, line 47, "images" should read --image--;

Column 9, line 48, "be developing" should read --by developing--; "image" should read --images--;

UNITED STATES PATENT OFFICE

CERTIFICATE OF CORRECTION

Patent No. 3,941,591 Dated March 2, 1976

Inventor(s) HIROSHI HANADA, ET AL. Page 2 of 2

It is certified that error appears in the above-identified patent and that said Letters Patent are hereby corrected as shown below:

Column 2, line 5, "mostly" should read --merely--;

Column 5, line 44, "the a phase" should read --a phase--;

Column 7, lines 43 and 44, "The powders having a Se, Te, and Ge of purity of more than" should read --The powders of Se, Te, and Ge having a purity of more than--;

Column 9, lines 45 and 46, "tungsten lamp to each surface of each photosensitive layer" should read --tungsten lamp to the surface of each photosensitive layer--;

Column 10, line 13, "images" (first occurrence) should read --image--;

Column 10, line 13, "image" (second occurrence) should read --images--;

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*